US006375430B1

(12) United States Patent
Eckert et al.

(10) Patent No.: US 6,375,430 B1
(45) Date of Patent: Apr. 23, 2002

(54) SUMP PUMP ALARM

(75) Inventors: Lee H. Eckert, Loveland; Kenneth P. Frey, Cincinnati; Scott R. Graham, Westchester, all of OH (US)

(73) Assignee: Campbell Hausfeld/Scott Fetzer Company, Harrison, OH (US)

( * ) Notice: Subject to any disclaimer, the term of this patent is extended or adjusted under 35 U.S.C. 154(b) by 0 days.

(21) Appl. No.: 09/562,500

(22) Filed: May 3, 2000

(51) Int. Cl.[7] ..... F04B 49/04

(52) U.S. Cl. ..... 417/40; 417/41; 417/36; 417/572; 417/423.3; 417/63

(58) Field of Search ..... 417/36, 63, 423.3, 417/572, 40, 41

(56) References Cited

U.S. PATENT DOCUMENTS

| | | | | | |
|---|---|---|---|---|---|
| 2,927,174 | A | * | 3/1960 | Walshin | 200/84 |
| 3,005,068 | A | * | 9/1961 | Pollak | 200/84 |
| 3,726,606 | A | * | 4/1973 | Peters | 417/7 |
| 3,932,853 | A | * | 1/1976 | Cannon | 340/244 |
| 4,021,144 | A | * | 5/1977 | Matsusaka | 417/40 |
| 4,084,073 | A | * | 4/1978 | Keener | 200/84 R |
| 4,222,711 | A | * | 9/1980 | Mayer | 417/7 |
| 4,456,432 | A | * | 6/1984 | Mannimo | 417/2 |
| 5,055,000 | A | * | 10/1991 | Akhter | 417/40 |
| 6,203,281 | B1 | * | 3/2001 | Gurega | 417/40 |

OTHER PUBLICATIONS http://www.comus–intl.com/product.html.*
http://www.superflex.com/sts2.htm.*
http://www.intlcomponents.com/misc_conduit.shtml.*

* cited by examiner

*Primary Examiner*—Charles G. Freay
*Assistant Examiner*—William H Rodriguez
(74) *Attorney, Agent, or Firm*—Jones, Day, Reavis & Pogue

(57) ABSTRACT

A sump pump has a float operated alarm switch mounted on the top end of the pump housing for activating an alarm when water rises above a normal operating level. The alarm is in a remote enclosure with the pump power plug so that plugging in the unit automatically positions the alarm in a desirable location to be heard. The power cord and alarm switch wire extend through a flexible corrugated tube that is attached to the pump housing and the alarm enclosure by strain relief connections that do not compressively crush the tube.

35 Claims, 10 Drawing Sheets

SUMP PUMP ALARM

BACKGROUND OF THE INVENTION

This application relates to the art of condition responsive alarms and, more particularly, to alarms that are activated in response to an undesirably high water level. The invention is particularly applicable for use with electric sump pumps and will be described with specific reference thereto. However, it will be appreciated that the invention has broader aspects, and that certain features of the invention may be used for other purposes and in other environments.

A submersible sump pump typically is operated by an automatic float switch that turns the pump on when the water level in a sump or pit rises above a predetermined level and shuts the pump off when the water level falls as a result of pump operation. These switches are well-known in the industry for use in controlling the level of water in the sump and commonly are referred to as float, tether, or electronic sensor type switches.

When a switch or pump fails to operate due to defect, malfunction, power outage or blockage in the system, the water level rises in the sump and ultimately may lead to a flood in that location. The water level also may rise due to an excessive inflow of water that exceeds the pump flow capacity. A known commercially available water sensor has metal or metalized contacts and activates an audible alarm when bridged with water. These water sensor alarms may sit on the floor in proximity to the sump, or may have an extension of wire that permits the contacts to hang down into the sump pit from above.

It is extremely difficult to precisely locate existing devices for providing the earliest possible warning to a homeowner. The surfaces of contact sensors that are exposed to basement moisture and ground water develop mineral deposits that act as an electrical insulator and prevent the alarm from being actuated when the water level rises too high.

Independent contact sensors are difficult or impossible to locate precisely at a given height when used with a submersible sump pump. Typically, they are mounted outside of the sump on the basement floor and provide a late warning only after the water has already breached the sump pit. A contact sensor mounted to a pump inside the sump pit at a height low enough to give an early warning would be highly susceptible to false alarms. This is because the entry of water into a sump most commonly is from drain tiles located at or above the top of the pump and this causes splashing that may trigger a contact sensor.

There is no easy or reliable way for the end user to accurately install a sensor for a given pump at the correct height to be low enough for early warning while avoiding false alarms.

SUMMARY OF THE INVENTION

In accordance with the present application, an alarm float switch assembly is incorporated into the physical structure of the pump itself. This makes it possible to customize the alarm system to each type of pump for providing early warning of an impending problem while minimizing any tendency to trigger false alarms.

In a preferred arrangement, the alarm float switch assembly includes a sealed switch that may be an encapsulated reed switch. In this preferred arrangement, a float that surrounds the reed switch and carries a magnet is lifted by an undesirably high water level to operate the reed switch and activate an alarm. The alarm switch may be either normally open or normally closed, and is moved to its opposite state for triggering the audible alarm.

The alarm float switch assembly may be arranged to activate the alarm when the water level rises between ½ to 2 inches above the normal maximum operating water level. Location of the float alarm switch assembly for triggering the alarm at a water level 1 inch above the normal maximum operating level is an optimum location to provide the earliest warning practical while avoiding false alarms due to water turbulence.

The audible alarm is located in an enclosure that includes the power plug. The alarm is battery operated and a battery compartment is located in the rear of the enclosure. The act of placing the power plug in an electrical socket automatically positions the audible alarm in a highly desirable location for being heard because the electrical receptacle normally is at least several feet above floor level. Replacement of the battery requires separation of the power plug from the electrical socket.

In accordance with one arrangement, the alarm switch is mounted on a switch support that is secured to the top end of the pump housing and projects outwardly therefrom. A magnetically operated reed alarm switch depends from the switch support and has a float carried thereby. A combined cover and strain relief member is positioned over the switch support to protect the switch alarm wire that extends from the reed switch to the alarm module in the remote enclosure.

In a preferred arrangement, the power cord and alarm switch wire extend from the remote enclosure to the pump housing through a flexible corrugated tube having an end portion attached to the pump housing at the switch support by a strain relief connection. An upright support sleeve on the switch support is received in an open end portion of the corrugated tube and has a plurality of outwardly extending circumferential ribs received in internal circumferential grooves within the tube. The combined cover and strain relief member has opposed parts with an opening therein that fits around the upright support sleeve and the end portion of the corrugated tube. A plurality of inwardly extending circumferential ribs on the cover member are received in external circumferential grooves on the corrugated tube. Reception of the ribs within the internal and external grooves on the tube prevents longitudinal separation of the corrugated tube from the pump housing.

In a preferred arrangement, the end portion of the corrugated tube is not tightly clamped or compressed between the opposed parts of the cover member and the upright support sleeve, and the fit is such that the corrugated tube can rotate relative to the upright sleeve and the cover member while being incapable of longitudinal separation therefrom.

The advantageous type of strain relief provided by the corrugated tube attachment may have applications in many different devices other than sump pumps.

It is a principal object of the present invention to provide an improved alarm switch arrangement for a sump pump.

It is also an object of the invention to provide an improved connecting arrangement for connecting an end portion of a corrugated tube to a housing without crushing or compressing the corrugated tube.

It is a further object of the invention to provide a sump pump with a float alarm switch assembly having a sealed switch that is magnetically operated by a magnet carried by a float that slides along the sealed switch.

It is a further object of the invention to provide an alarm arrangement for a sump pump wherein an audible alarm is located in a remote enclosure along with the pump power plug.

DESCRIPTION OF A PREFERRED EMBODIMENT

Figure 1:
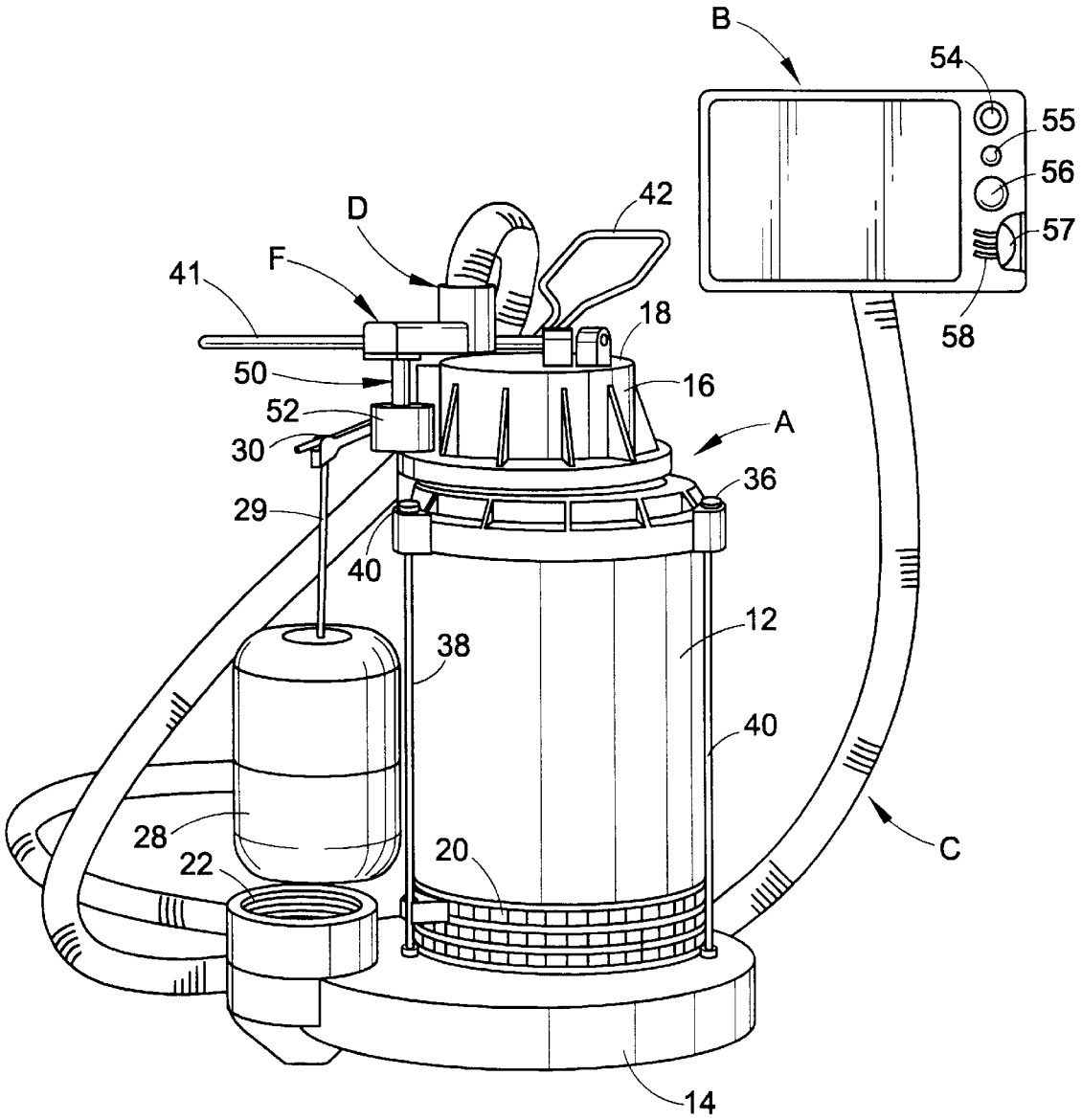
FIG. 1 is a front elevational view of a sump pump having the improvements of the present application incorporated therein.
Figure 2:
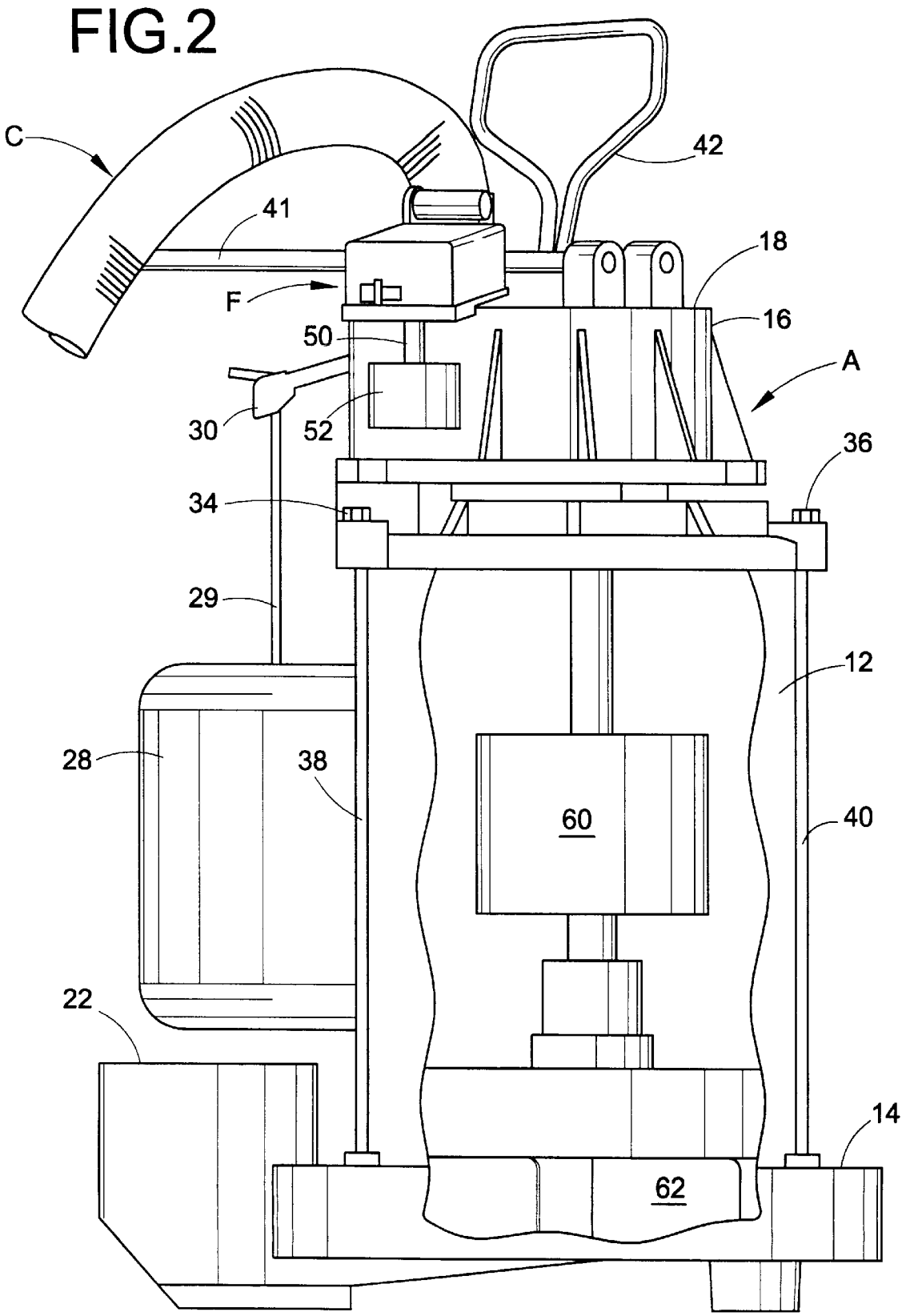
FIG. 2 is a front elevational view of the sump pump of FIG. 1 with a portion of the housing broken away for clarity of illustration.

Referring now to the drawing, wherein the showings are for purposes of illustrating a preferred embodiment of the invention only and not for purposes of limiting same, FIG. 1 shows a sump pump A having a housing 12 that includes a volute 14 and a cap member 16 with a top end 18. A screened peripheral inlet 20 adjacent base 14 provides intake of water for discharge through outlet 22 that is connected with a suitable discharge pipe.

A main float 28 is suspended by a rod 29 from the end of a pivoted lever 30 that operates a switch for activating and deactivating the pump in response to predetermined water levels. The physical characteristics of float 28, rod 29 and lever 30 may be selected to activate and deactivate the pump at any desired water levels. In one arrangement, the components are arranged for activating the pump when the water level reaches the top surfaces 34, 36 of elongated bolts 38 and 40 that hold the pump housing parts together. The pump then is deactivated when the water level falls several inches below top surfaces 34 and 36 of the bolt heads. Obviously, other normal operating levels may be chosen if so desired.

The pump housing has a float guard 41, and a handle 42 is attached to the housing for use in transporting and installing the sump pump. A combined power plug and alarm enclosure B is attached to sump pump A by a corrugated tube C through which the power cord and an alarm switch wire extend. Corrugated tube C is attached to the pump housing at a strain relief connection D, and the power cord extends through an opening in the pump housing to the power switch and motor. Corrugated tube C prevents abrasion and tangling of the power cord and alarm switch wire, and facilitates sealing of the sump by a sump cover that requires only one sealable opening for the corrugated tube.

The alarm switch wire is connected with an alarm switch 50 that is operated by movement of an alarm switch float 52 to activate the audible alarm within enclosure B when the water level is above the normal maximum operating level. Enclosure B includes a battery and system test button 54, a light emitting diode 55 that constantly is illuminated when the battery is charged and the system is armed, a strobe light 56 that pulses high intensity visual warning signals when the alarm switch closes, and a speaker 57 behind enclosure openings 58 through which loud audible warning signals are emitted when the alarm switch closes. An electronic module is provided within the enclosure for operating the audible and visual alarms, the LED and the test button. The battery operated LED 55 also helps to locate the alarm enclosure and guide a person toward same in the event of a power outage. Obviously, the strobe light and speaker may be provided in the alternative rather than in combination.

The alarm switch preferably is arranged to activate the alarm when the water level is ½ inch to 2 inches above the normal maximum operating water level. In one arrangement, the alarm switch has been arranged to activate the alarm when the water level is 1 inch above the normal maximum operating water level to provide the earliest warning practical while avoiding false alarms due to water turbulence. It will be recognized that the water level at which the alarm switch activates the alarm may be varied. The most important consideration is that the water level at which the alarm switch activates the alarm should be far enough above the normal operating water level to avoid false alarms and hunting of the alarm switch between open and closed positions as the water level varies slightly above and below the normal operating level.

An electric motor 60 within pump housing 12 drives an impeller 62 for discharging water through outlet 22 that has entered the impeller through inlet 20.

Figure 5:
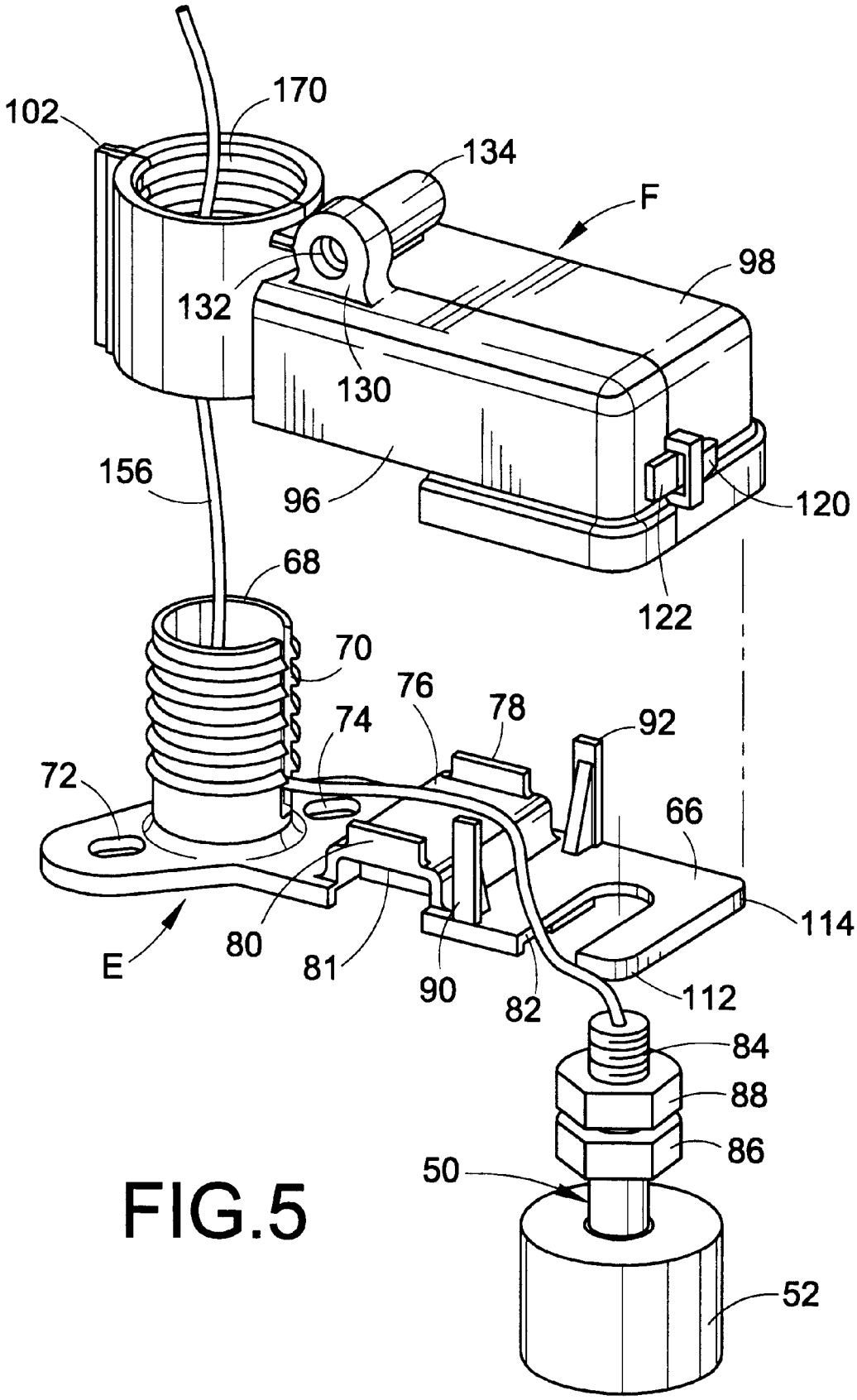
FIG. 5 is an exploded perspective illustration of the alarm switch, the alarm switch support and the cover.
Figure 6:
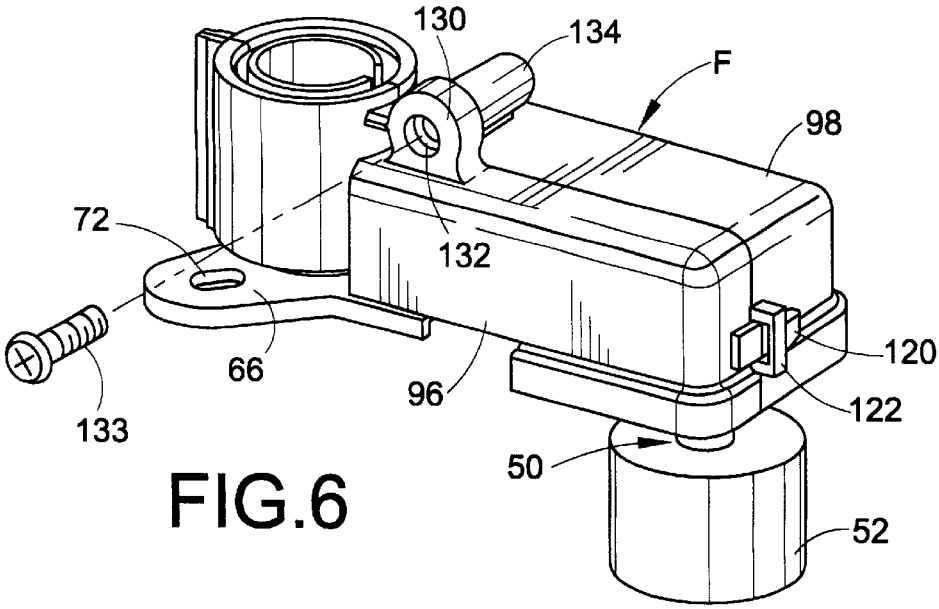
FIG. 6 is a perspective illustration of the individual components of FIG. 5 in assembled relationship.

With reference to FIG. 5, a switch support E has a base 66 with a support sleeve 68 extending upwardly therefrom. A vertical slot 70 through the peripheral wall of sleeve 68 allows passage of an alarm switch wire from the interior of support sleeve 68 to the exterior thereof. Screw receiving openings 72 and 74 in base 66 receive screws for securing switch support E to the top end of the pump housing. A raised saddle 76 having opposite upright sidewalls 78 and 80 provides a guideway for the alarm switch wire that extends through the vertical slot in support sleeve 68 to the alarm switch. Opposite bottom recesses beneath saddle 76, only one of which is shown at 81 in FIG. 5, are provided for receiving locking projections on a cover member as described hereafter.

An elongated transverse opening 82 in base 66 of switch support E receives a threaded end portion 84 on switch assembly 50. An enlarged hexagonal nut 86 on switch assembly 50 is positioned against the bottom surface of switch support base 66. A nut 88 then is threaded on threaded end portion 84 into engagement with the upper surface of base 66 for attaching switch assembly 50 to switch support E by trapping the support base between the nuts. Obviously, other fastener arrangements, such as snaps, could be used in place of threads. A pair of opposite posts 90 and 92 extend upwardly from switch support base 66 to guide the switch wires and to prevent relative rotation between switch support E and a cover/strain relief member F.

Figure 4:
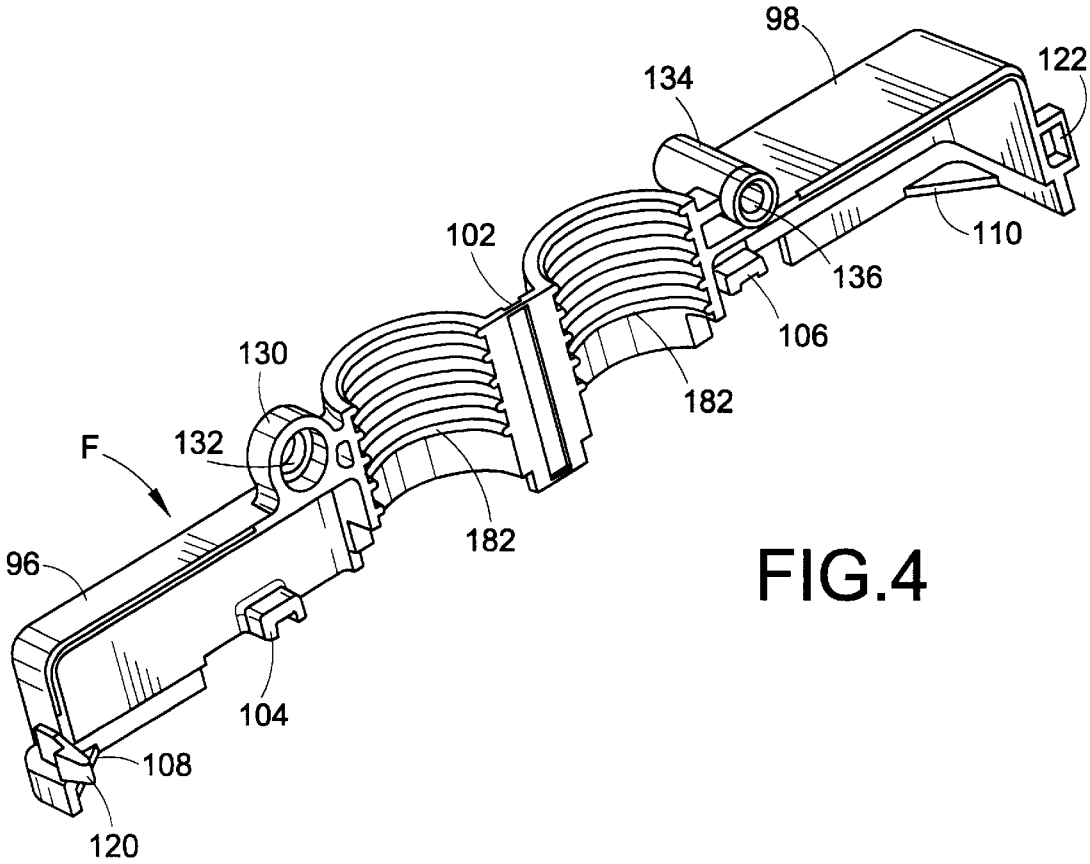
FIG. 4 is a perspective illustration of a cover member prior to assembly to function as an alarm switch cover.

Referring to FIG. 4, combined switch support cover and strain relief member F has opposed parts 96 and 98 integrally connected by a living hinge 102 for providing movement of the parts toward one another. Part 96 has a projection 104 that is receivable within recess 81 beneath saddle 76 on switch support E of FIG. 5 when parts 96, 98 are moved into abutting relationship with one another. A similar projection 106 on part 98 is receivable in the recess on the opposite side of saddle 76 from recess 81.

Corner projections 108 and 110 on parts 96 and 98 are receivable beneath corners 112 and 114 on base 66 of switch support E when cover and strain relief member F is assembled thereto. This acts as an assembly aid and further interlocks the cover with the support to prevent separation thereof.

Figure 3:
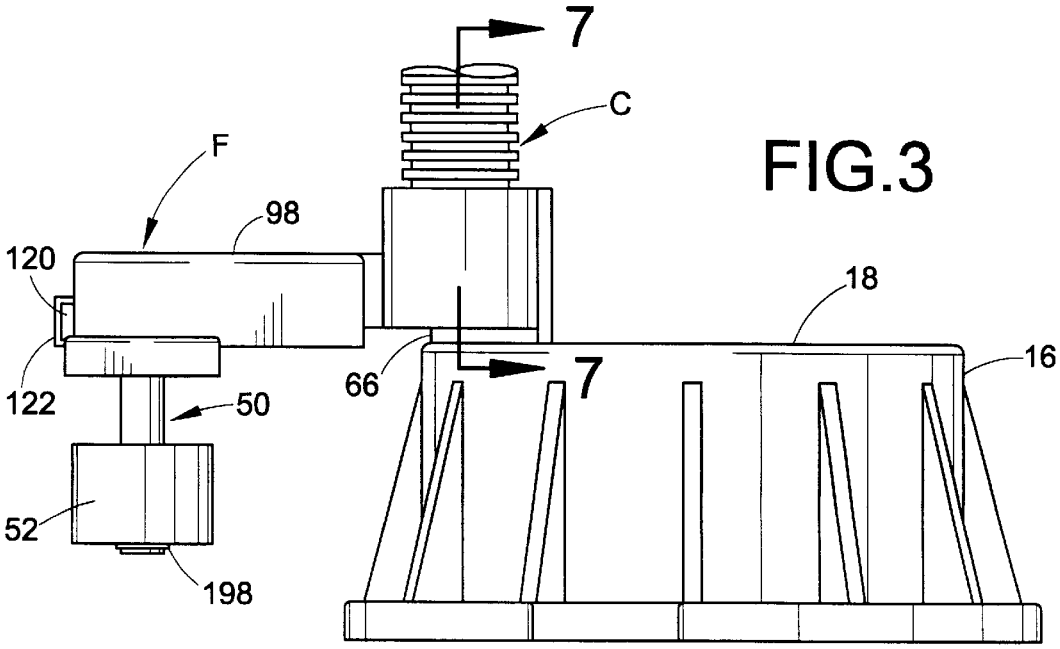
FIG. 3 is a side elevational view of a top end portion of the sump pump housing showing the alarm switch of the present application mounted thereon.

A latch projection 120 on part 96 is receivable through an opening in a latch keeper 122 on part 98 to lock the parts against separation when they are moved toward one another into abutting relationship. A boss 130 on part 96 has a hole 132 therethrough that is dimensioned to freely receive a screw 131 with clearance. Another boss 134 on part 98 has a hole 136 therein that is dimensioned for threading of a self-threading screw 131 therein. When parts 96 and 98 are swung toward one another, holes 132 and 136 are aligned so that a screw may be inserted through hole 132 and threaded into hole 136 for securing the parts together against unintentional separation. FIG. 3 shows alarm switch 50 suspended from the outer end portion of the cantilevered support that is mounted on and extends outwardly from the top end 18 of the pump housing.

Figure 7:
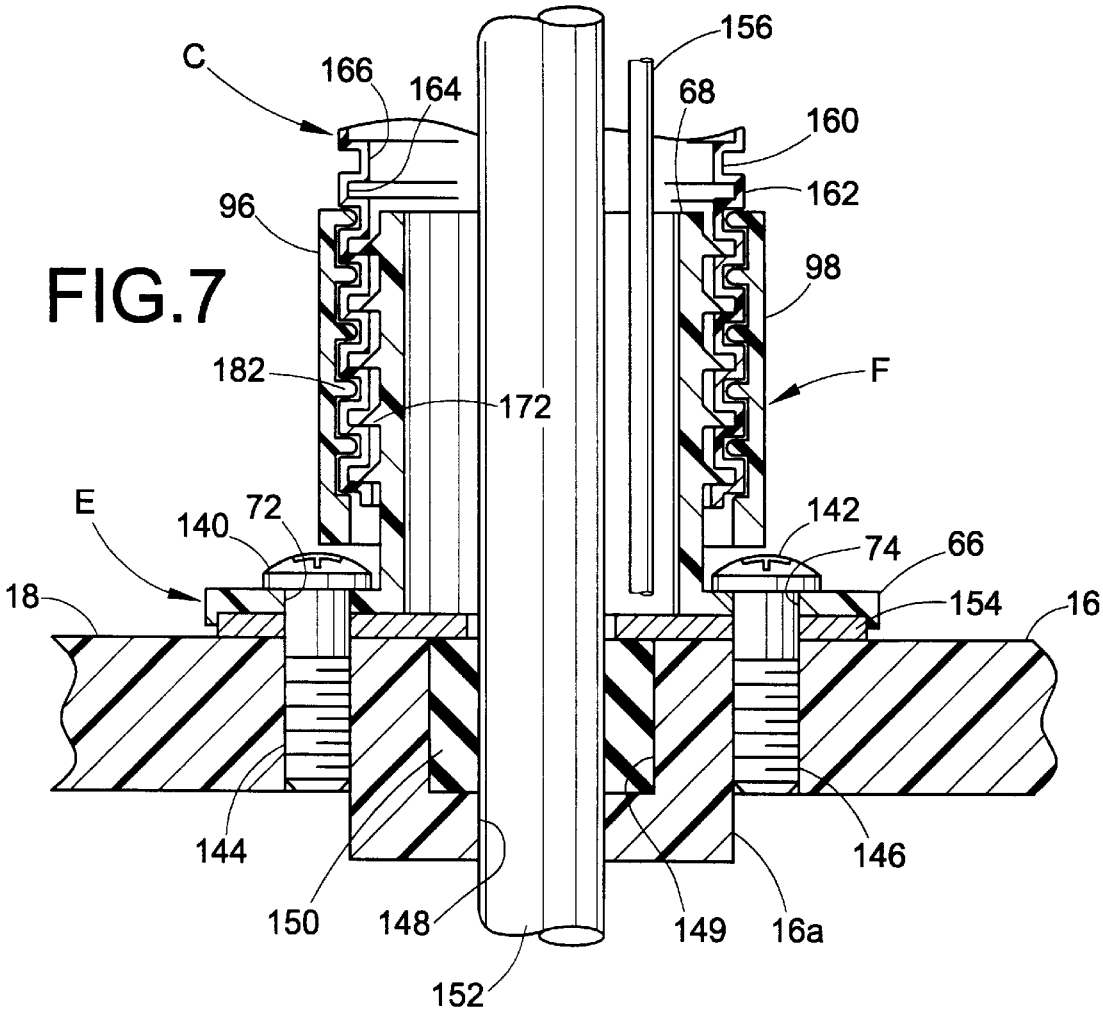
FIG. 7 is a partial cross-sectional elevational view taken generally on line 7—7 of FIG. 3.

FIG. 7 shows base 66 of alarm switch support E secured to top end 18 of housing cap member 16 by screws 140 and 142 that extend freely through holes 72 and 74 in base 66 and thread into holes 144, 146 in cap member 16. A hole 148 through an internal ledge portion 16*a* of cap member 16 is aligned with a larger cylindrical bore 149. Power cord 152 extends through hole 148 and bore 149, and an elastomeric bushing 150 surrounds the power cord within bore 149.

A metal washer 154 beneath base 66 of alarm switch support E compresses bushing 150 against ledge portion 16*a*, and deforms same into sealed relationship with bore 149 and power cord 152. Alarm switch wire 156 is shown alongside power cord 152 in FIG. 7, and it will be recognized that the wire extends laterally through slot 70 of FIG. 5 in sleeve 68 for connection with alarm switch 50.

Flexible corrugated tube C has external and internal circumferential grooves and ridges therein. An external circumferential groove and an external circumferential ridge are identified by numerals 160 and 162 in FIG. 7. An internal circumferential groove and an internal circumferential ridge are identified by numerals 164 and 166 in FIG. 7. Although other configurations are possible, the circumferential grooves and ridges preferably are squared off as illustrated in the drawing rather than being rounded. Thus, the sidewalls of the ridges and grooves extend radially of the tube longitudinal axis, while the bottom surfaces of the grooves and the outer surfaces of the ridges extend parallel to the tube longitudinal axis.

When parts 96, 98 of cover member F in FIG. 4 are swung toward one another about hinge 102, cooperating semicylindrical recesses therein form a cylindrical opening 170 shown in FIG. 5. Upright support sleeve 68 on alarm switch support E has a plurality of longitudinally-spaced external circumferential ribs thereon, only one of which is identified by numeral 172 in FIG. 7. The external diameter of ribs 172 at their outer ends is greater than the internal diameter of corrugated tube C at the internal ridges thereof.

Corrugated tube C has sufficient elasticity to permit forcing of the tube end portion down over support sleeve 68 as the internal tube ridges snap past ribs 172 which then are received in the tube internal grooves. The upper surfaces of ribs 172 are sloped downwardly toward their outer ends to provide cam surfaces to facilitate snapping of the tube internal ridges past the ribs as the tube end portion is pushed down over the support sleeve. The lower surfaces of ribs 172 extend radially of support sleeve 68 and engage sidewalls of the tube internal grooves to hold the tube end portion on the sleeve as shown in FIG. 7.

With parts 96, 98 of cover member F open as shown in FIG. 4, the cover member is positioned adjacent to switch alarm support E and closed around the tube end portion that is received over sleeve 68. Opposite parts 96, 98 are moved into abutting relationship and interlock with support base 66 as previously described. The opening 170 of FIG. 5 between parts 96, 98 of cover member F has a plurality of inwardly extending longitudinally-spaced circumferential ribs thereon, only one of which is identified by numeral 182 in FIG. 7. Ribs 182 are received in the external circumferential grooves in the end portion of corrugated tube C as shown in FIG. 7.

Also as shown in FIG. 7, the longitudinal spacing between sleeve external ribs 172 is approximately the same as the spacing between the tube internal grooves, while the longitudinal spacing between ribs 182 on the cover member is approximately the same as the longitudinal spacing between the external grooves on the tube end portion. Reception of ribs 172 and 182 within the internal and external grooves on the tube end portion prevents longitudinal separation of the tube from its attachment to the pump housing. This provides strain relief for power cord 152 and alarm switch wire 156.

Ribs 172 and 182 are longitudinally staggered relative to one another, with each rib 172 being located between a pair of ribs 182, and each rib 182 being located between a pair of ribs 172.

Corrugated tube C is made of a suitable plastic material such as polyethylene and is very thin. Consequently, it has been found to be undesirable to compress the end portion of tube C between sleeve 68 and parts 96, 98 because the tube might be crushed and damaged to the extent that it would break or become cosmetically deformed upon exit of strain relief. Therefore, the fit between the parts is such that the end portion of corrugated tube C can rotate relative to support sleeve 68 and cover member F when in the position shown in FIG. 7 but cannot move longitudinally because of the interlocking relationship of ribs 172, 182 with the internal and external tube grooves. The free rotation also prevents twisting-induced damage to the tube.

Strictly by way of example and not by way of limitation, corrugated tube C may have a nominal wall thickness of 0.016 inch, an external diameter across an external ridge of 13/16 inch and an external diameter across the bottom of an external groove of 11/16 inch.

Figure 8:
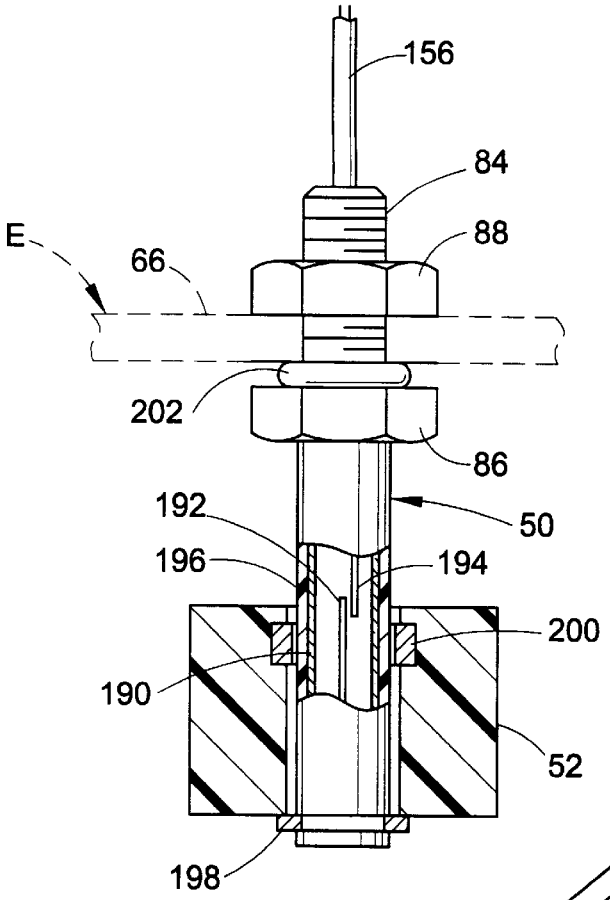
FIG. 8 is a front elevational view showing the alarm switch of the present application suspended from a support, and with portions cut-away and in section for clarity of illustration.
Figure 9:
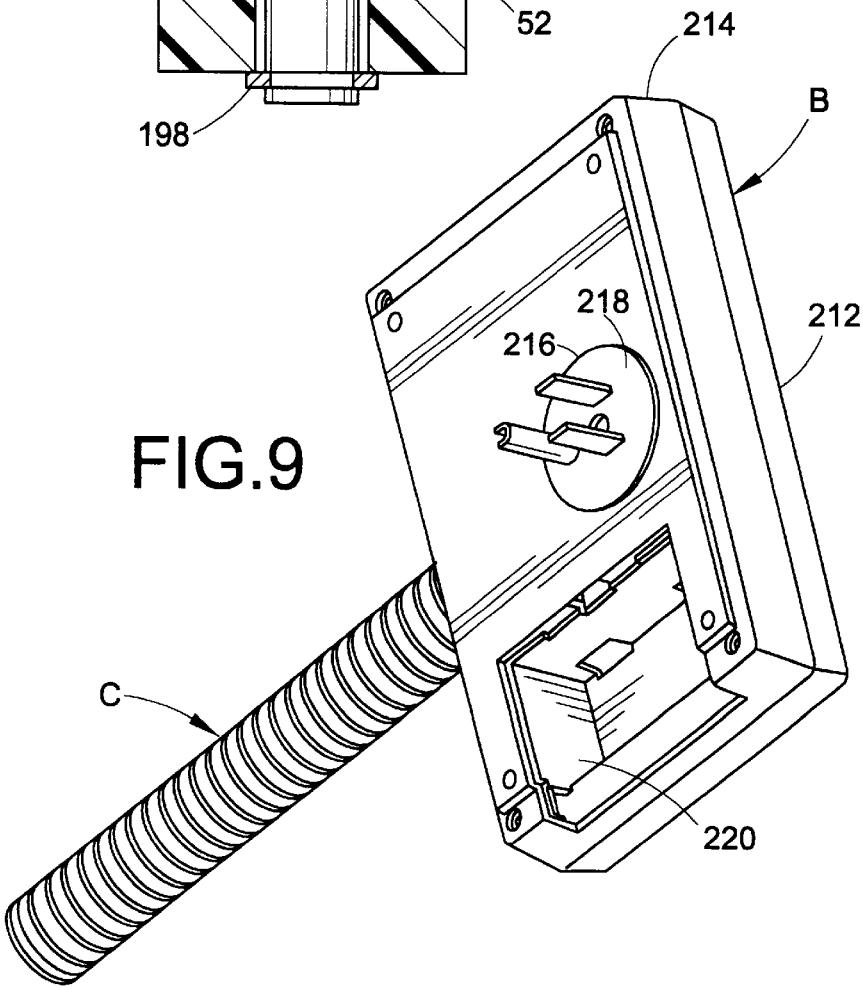
FIG. 9 is a rear perspective illustration of an enclosure for the power cord plug and an alarm.

FIG. 8 shows alarm switch 50 in the form of a magnetic reed switch having a glass tube 190 in which a pair of reeds 192 and 194 are mounted for cooperation with one another. In the arrangement shown, reeds 192 and 194 are shown as being normally open although it will be appreciated that it is possible to arrange the device so that the reed contacts are normally closed. Sealed glass tube 190 is itself sealed within a plastic sleeve 196 and suitable leads are provided for connecting the reeds with alarm switch wire 156. A suitable circumferential groove in the end portion of plastic sleeve 196 receives a snap ring 198 to retain float 52 thereon.

An annular permanent magnet 200 carried by float 52 opens the normally closed reeds when the float moves up along plastic sleeve 196. In the alternative, magnet 200 could open reeds that are normally closed upon upward movement of float 52. Sufficient clearance is provided between magnet 200 and plastic sleeve 196, and between float 52 and plastic sleeve 196, to permit free sliding movement of float 152 along sleeve 196 without hanging up thereon. An elastomeric ring 202 is shown between the bottom surface of base 66 on alarm switch support E and the top surface of nut 86. Float 52 and magnet 200 are cylindrical with central cylindrical holes freely receiving plastic sleeve 196 with clearance.

Enclosure B for the power plug and the alarm module has front and rear enclosure parts 212 and 214. A circular opening 216 is provided in rear enclosure part 214 for receiving a circular power plug 218 so that the power plug prongs project rearwardly from the enclosure. A battery compartment 220 also is provided in rear enclosure part 214 for receiving a conventional nine volt battery. A battery cover 222 is provided for the battery compartment and a battery connector 224 is connected with electronic module 230 by a wire 232. Electronic module 230 in turn is connected with the alarm switch by wire 156 that extends through corrugated tube C.

The interior of front enclosure part 212 has hollow posts extending upwardly therefrom for use in attaching electronic module 230 thereto. Only one such post is shown at 236 in FIG. 10 for receiving a screw that extends through a suitable hole in the support for electronic module 230.

Electronic module 230 monitors the battery and supplies constant voltage to indicator light 55 when the battery condition is satisfactory. When the battery charge drops below a threshold value, module 230 causes indicator light 55 to blink on and off to provide an alert that there is a problem requiring attention. Obviously, module 230 also may cause speaker 57 and/or strobe light 56 to broadcast intermittent alert signals of lower intensity and frequency than the warning signals when the battery or system require attention. When the battery or system require attention, module 230 also may cause speaker 57 and/or strobe light 56 to broadcast intermittent alert signals of much lower frequency and intensity than the warning signals that are broadcast when alarm switch 50 closes. Upon closing of alarm switch 50, module 230 drives one or both of speaker 57 and strobe light 56 to broadcast warning signals of high frequency and intensity. Test button 54 may be pushed to momentarily activate speaker 57 and/or strobe light 55 for testing the battery and operation of the system.

A cylindrical projection 240 extends rearwardly from the interior of front enclosure part 212. Alternating circumferential lugs and recesses are provided on the interior surface of projection 240, and only one such lug and one such recess are indicated by numerals 242 and 244 in FIG. 10. The circumferential width of each lug is approximately the same as the circumferential width of each recess, and there are eight lugs and eight recesses that alternate with one another around the peripheral end portion of cylindrical projection 240.

Figure 10:
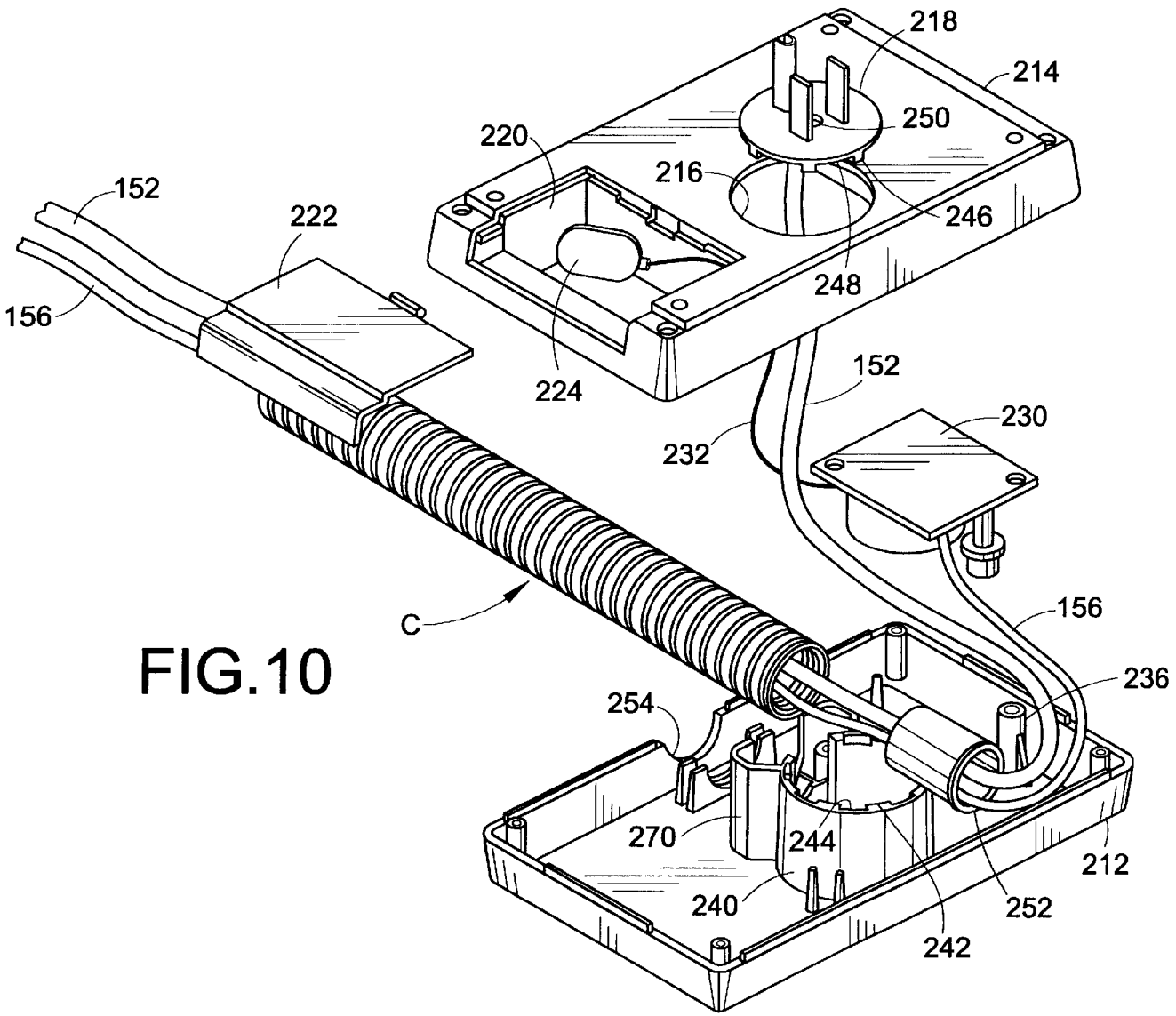
FIG. 10 is an exploded perspective illustration of the enclosure of FIG. 9.

The rear periphery of power plug 218 also has a plurality of alternating lugs and recesses thereon, and only one such lug and one such recess are indicated by numerals 246 and 248 in FIG. 10. Power plug 218 has eight lugs and recesses thereon alternating therearound. The circumferential width of each lug 246 is approximately the same as the circumferential width of each recess 248. In addition, the circumferential width of each lug 246 is approximately the same as the width of each lug 242, and the circumferential width of each recess 248 is approximately the same as the circumferential width of each recess 244.

Figure 12:
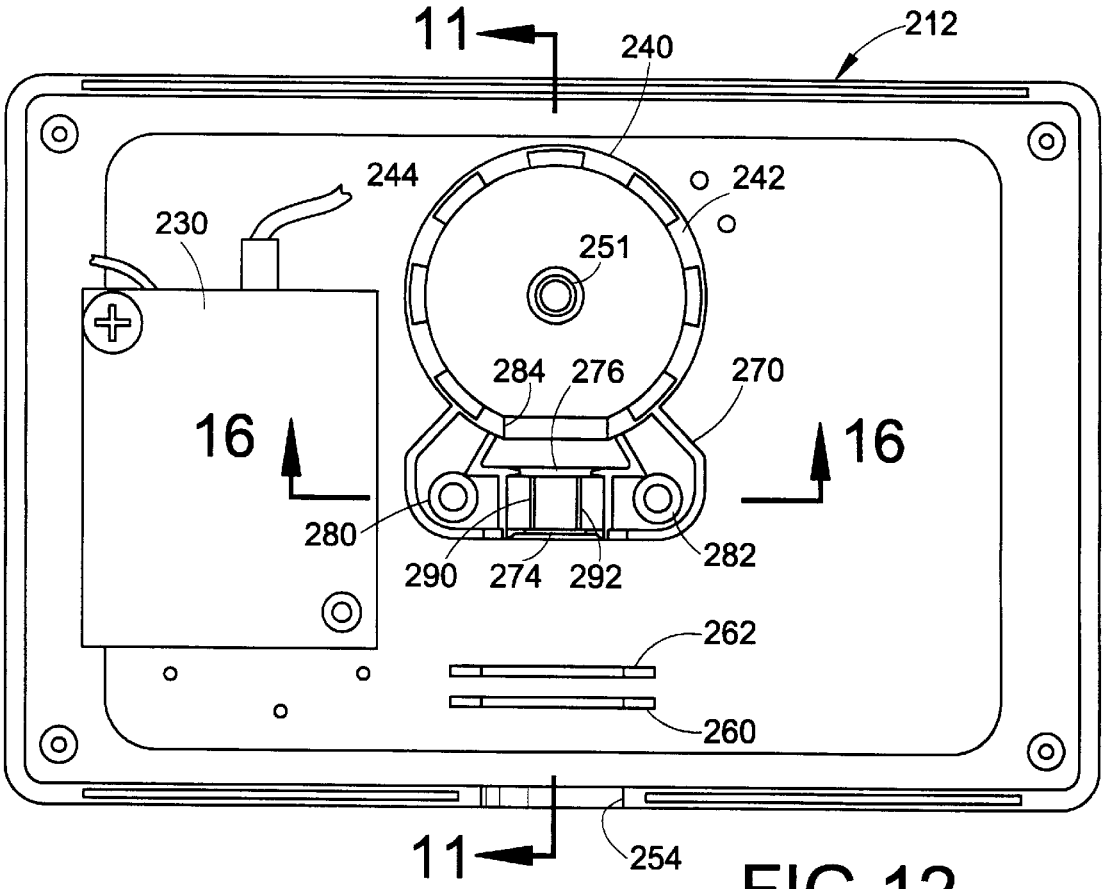
FIG. 12 is a plan view looking at the rear interior of a front enclosure part for an enclosure in which an alarm and a power plug are mounted.
Figure 13:
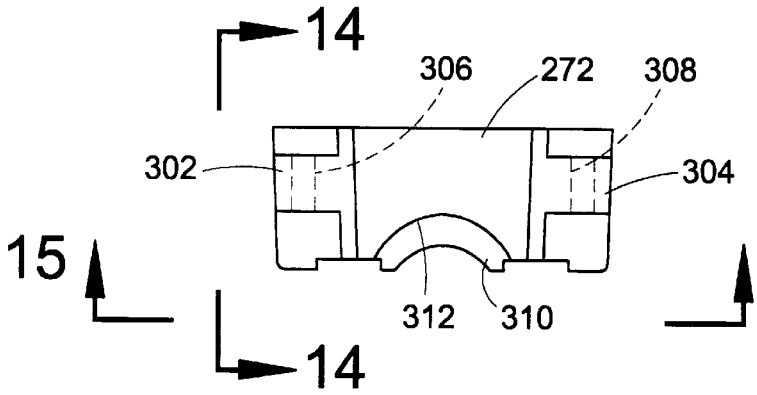
FIG. 13 is a front elevational view of a clamp member used with features of the front enclosure part of FIG. 12 to provide power cord strain relief.
Figure 14:
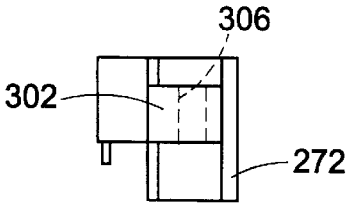
FIG. 14 is a side elevational view taken generally on line 14—14 of FIG. 13.
Figure 15:
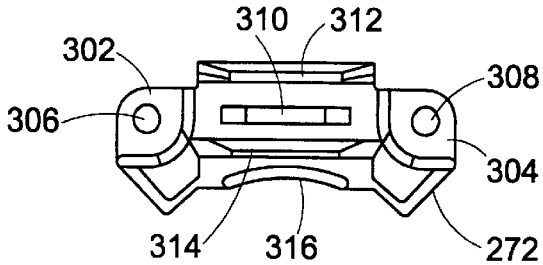
FIG. 15 is a bottom plan view taken generally on line 15—15 of FIG. 13.
Figure 16:
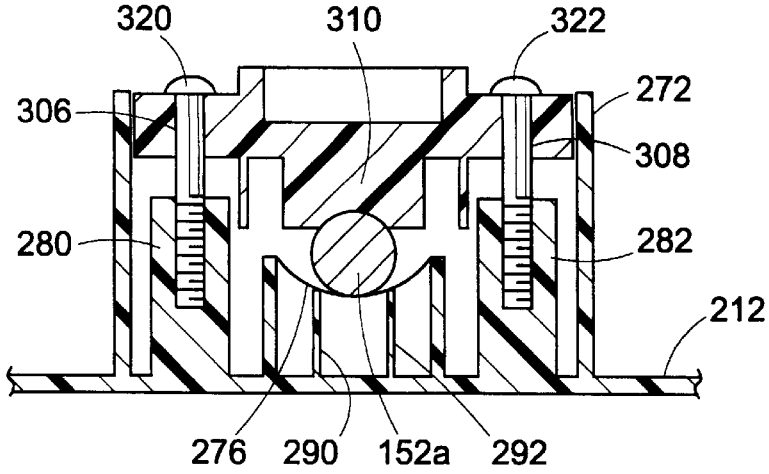
FIG. 16 is a partial cross-sectional elevational view taken generally on line 16—16 of FIG. 12.

Lugs 246 on power plug 218 are receivable within recesses 244 on cylindrical projection 240 of front housing part 212. Likewise, lugs 242 are receivable in recesses 248 on power plug 218. Power plug 218 has a central hole 250 for freely receiving a screw therethrough which threads into a hole in a central boss 251 in FIG. 12 projecting upwardly internally of cylindrical projection 240 on front housing part 212.

The described arrangement permits rotational indexing of power plug 218 relative to the enclosure to enable reception of the power plug prongs within a socket of any orientation without having to invert enclosure B or position same at an awkward angle. Thus, it is possible to connect the power plug with an electrical socket so that corrugated tube C always will be at the bottom of enclosure B instead of extending upwardly therefrom or from the sides thereof toward the sump pump.

Figure 11:
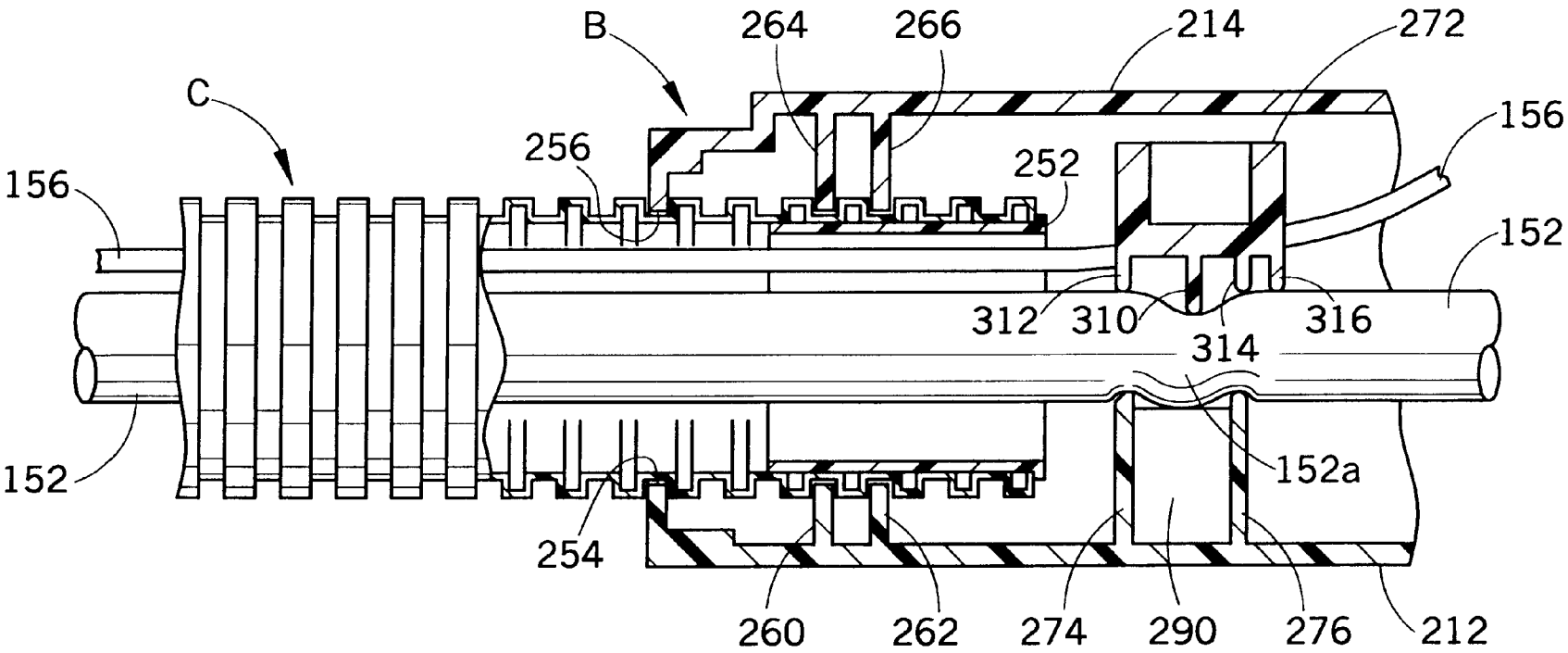
FIG. 11 is a cross-sectional elevational view taken generally on line 11—11 of FIG. 12.

As shown in FIG. 10, a rigid sleeve 252 is receivable within the open end portion of flexible corrugated tube C. Front and rear enclosure parts 212 and 214 have semicircular recesses 254 and 256 therein that cooperate to form a circular hole. The periphery of the housing parts around the hole is received within an external circumferential groove in corrugated tube C as shown in FIG. 11.

Front housing part 212 has ribs 260 and 262 extending rearwardly from the interior thereof for reception in adjacent external circumferential grooves in the end portion of corrugated tube C. Front housing part 214 also has ribs 264 and 266 projecting from the interior thereof for reception in adjacent external circumferential grooves in the end portion of tube C in alignment with sleeve 252. Ribs 260, 262, 264 and 266 have arcuate ends that are curved to approximately the same curvature as corrugated tube C for close reception in the tube external grooves.

The arrangement of the present application insures that enclosure B will be at a high elevation corresponding to the conventional location of an electrical outlet socket. This makes it convenient to provide a battery/alarm test button that is readily accessible and a battery condition/indicator light that is readily visible. Location of the battery compartment at the rear of the enclosure requires removal of the entire enclosure with the electrical plug from the electrical outlet to remove/change the battery.

With reference to FIGS. 10–16, a projection 270 adjacent to cylindrical projection 240 is provided for receiving a strain relief clamp 272 to clamp the power cord 152 against clamping edges on flanges 274, 276 upstanding from the interior of front enclosure part 212. Hollow posts 280, 282 within projection 270 receive screws for holding the cleat against the power cord.

Power cord 152 extends across central arcuate edges on flanges 274, 276 and enters cylindrical projection 240 through an opening 284 for attachment of the power cord wires to the power plug. Ribs 290, 292 extend between the arcuate edges on clamping flanges 274, 276 and are spaced-apart a distance less than the diameter of the cylindrical power cable.

Strain relief clamp 272 has opposite end ears 302, 304 with screw receiving holes 306, 308 therethrough. The bottom of strain relief clamp 272 has a central primary clamping projection 310 extending downwardly therefrom and a pair of secondary clamping projections 312, 314. A supplemental projection 316 on strain relief clamp 272 faces opening 284 in cylindrical projection 240 for the power plug.

Strain relief clamp 272 is closely received and guided within hollow projection 270. Screws 320, 322 extend through holes 306, 308 in clamp 272 and thread into posts 280, 282 within hollow projection in front enclosure part 212. In this position, primary clamping projection 310 on clamp 272 is centered between clamping flanges 274, 276 on front enclosure part 212 as shown in FIG. 11. The thickness of primary clamping projection 310 is significantly less than the spacing between clamping flanges 274, 276 as shown in FIG. 11. Secondary clamping projections 312, 314 are aligned with clamping flanges 274, 276. The distance between the end of clamping projection 310 and the facing ends of clamping flanges 274, 276 is less than the diameter of power cable 152 so that the power cable is deformed downwardly between clamping flanges 274, 276 as indicated at 152*a* in FIG. 11. The surface of the power cord opposite from primary clamping projection 310 on clamp 272 engages ribs 290, 292. This arrangement provides a firm strain relief connection for the power cord to prevent pulling forces on the power cord from being transmitted to the connections between the power cord wires and the power plug.

Figure 17:
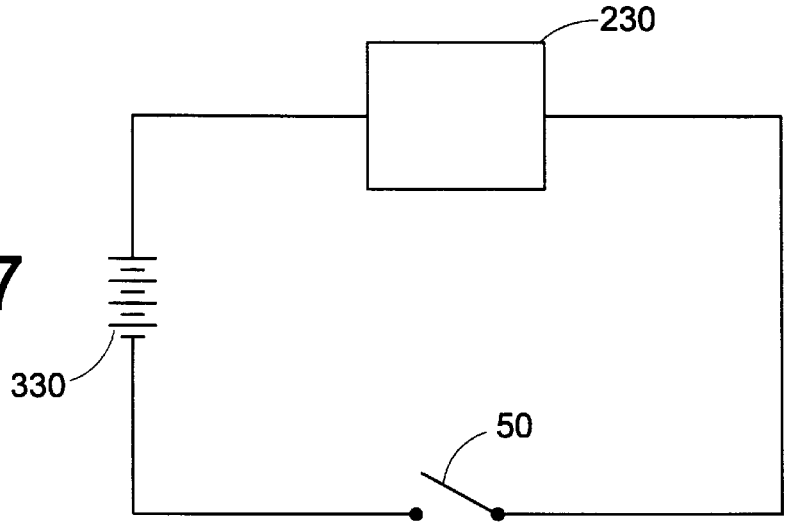
FIG. 17 is a simplified schematic illustration of an alarm circuit.
Figure 18:
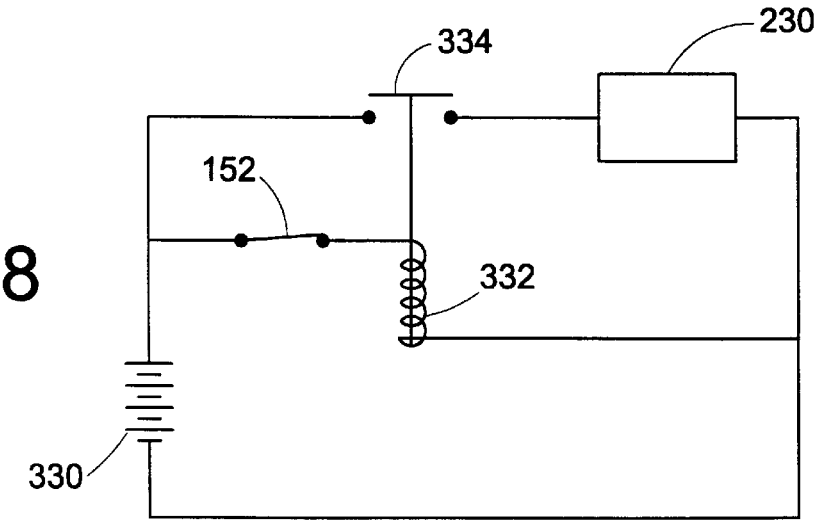
FIG. 18 is a simplified schematic illustration of another alarm circuit.

FIGS. 17 and 18 are simplified schematic showings of the alarm circuit. In FIG. 17, battery 330 operates alarm module 230 when normally open reed switch 50 closes upon upward movement of the float when the water rises a predetermined distance above normal operating level. In the arrangement of FIG. 18, reed switch 50 normally is closed to energize a relay 332 having a normally open relay contact 334. Obviously, a solid state device also may be maintained conductive by a trickle current through a normally closed switch. When the water rises a predetermined distance above the normal operating level and raises the float, normally closed reed switch 50 opens to de-energize relay 332 and close contacts 334 to activate alarm 230.

Although the invention has been shown and described with reference to a preferred embodiment, it is obvious that equivalent alterations and modifications will occur to others skilled in the art upon the reading and understanding of this specification. The present invention includes all such equivalent alterations and modifications, and is limited only by the scope of the claims.

We claim:

1. An electric sump pump having a liquid level alarm switch attached thereto, a power cord having one end connected with said sump pump and an opposite end attached to a plug remote from said pump, an alarm that is activated by said alarm switch, and a common enclosure for said plug and said alarm, whereby insertion of said plug into a socket locates said alarm and said enclosure in a desirable remote position relative to said pump.

2. The pump of claim 1 wherein said alarm is battery operated and said enclosure includes a battery compartment.

3. The pump of claim 1 including a flexible corrugated tube through which said power cord extends, and said tube being attached to said pump and to said enclosure at strain relief connections.

4. The pump of claim 1 wherein said pump includes a pump housing having a housing top end, an alarm switch support attached to said housing top end and having a cantilevered portion extending outwardly therefrom, and said alarm switch being mounted on said cantilevered portion.

5. The pump of claim 1 wherein said pump is activated at a predetermined normal operating water level and said alarm switch is positioned to activate said alarm when the water level is above said predetermined normal operating water level.

6. The pump of claim 5 wherein said switch is positioned to activate said alarm when the water level is ½ inch to 2 inches above said predetermined normal operating water level.

7. The pump of claim 1 wherein said alarm is battery operated and said enclosure includes a battery compartment, and said enclosure having a test button to test the battery and alarm.

8. The pump of claim 7 including a battery condition indicator light on said enclosure.

9. The pump of claim 1 including a power cord strain relief in said enclosure, said power cord being clamped by said strain relief to prevent pulling forces from being applied to the connections between said power cord and said plug.

10. A sump pump having a housing, said housing having a housing top end, a power cord opening in said top end, a switch support secured to said top end and projecting outwardly therefrom, said switch support having a support sleeve extending upwardly therefrom in alignment with said power cord opening, said support sleeve having longitudinally-spaced circumferential external ribs thereon, a flexible corrugated tube having alternating circumferential external and internal grooves and ridges along the length thereof, said corrugated tube having a tube end portion received over said support sleeve with said external ribs on said support sleeve received in said tube internal grooves, a cover member positioned over said support, said cover member having cooperating opposed parts with a cover opening therebetween receiving said tube end portion, and said cover opening having longitudinally-spaced inwardly extending circumferential ribs received in said tube external grooves.

11. The pump of claim 10 wherein said tube end portion is trapped in uncompressed relationship between said support sleeve and said cover opening so that said tube end portion is rotatable relative to said support sleeve and said cover but is not movable longitudinally relative to said support tube and said cover.

12. The pump of claim 10 including a switch assembly mounted on said switch support.

13. The pump of claim 12 wherein said switch assembly includes a switch and said switch assembly extends downwardly from said switch support.

14. The pump of claim 13 including a float vertically slidable on said switch assembly for operating said switch.

15. The pump of claim 12 wherein said switch assembly includes an alarm switch, a power cord extending through said power cord opening in said pump housing through said support sleeve and through said corrugated tube, said power cord having one end connected with said pump and an opposite end attached to a plug remote from said pump, an alarm that is activated by said alarm switch, a common enclosure for said alarm and said plug, and said corrugated tube being attached to said enclosure.

16. An electric sump pump having a liquid level sensing alarm switch mounted thereon, an alarm remote from said pump and said alarm switch, said alarm being electrically connected with said alarm switch, said alarm switch being operable to activate said alarm in response to a predetermined liquid level externally of said pump, said pump including a pump housing having a pump housing top end, a switch support extending outwardly from said pump housing top end, and said alarm switch being mounted on said switch support externally of said housing.

17. The pump of claim 16 wherein said alarm switch extends downwardly from said switch support.

18. The pump of claim 17 wherein said alarm switch includes a magnetically operable reed switch depending from said switch support, an annular float slidable upwardly and downwardly on said reed switch, and said float carrying a permanent magnet that operates said reed switch to activate said alarm upon upward movement of said float along said reed switch in response to a predetermined liquid level externally of said pump.

19. An electric sump pump having a liquid level sensing alarm switch mounted thereon, an alarm remote from said pump and said alarm switch, said alarm being electrically connected with said alarm switch, said alarm switch being operable to activate said alarm in response to a predetermined liquid level externally of said pump, said pump including an electric motor, a motor power cord attached to said pump and having a power plug remote from said pump, an alarm enclosure in which said alarm is mounted, and said power plug being attached to said alarm enclosure.

20. The pump of claim 19 wherein said alarm enclosure includes front and rear enclosure parts, and said front enclosure part having a power cord strain relief that clamps said power cord to said front enclosure part.

21. An electric sump pump having a liquid level sensing alarm switch mounted thereon, an alarm remote from said pump and said alarm switch, said alarm being electrically connected with said alarm switch, said alarm switch being operable to activate said alarm in response to a predetermined liquid level externally of said pump, said pump including an electric motor, a motor power cord attached to said pump and having a power plug remote from said pump, an alarm enclosure in which said alarm is mounted, said power plug being attached to said alarm enclosure, said plug being selectively rotatable relative to said enclosure, and cooperating interdigitating lugs and recesses between said plug and said enclosure to selectively lock said plug against rotation relative to said housing.

22. An electric sump pump having a liquid level sensing alarm switch mounted thereon, an alarm remote from said pump and said alarm switch, said alarm being electrically connected with said alarm switch, said alarm switch being operable to activate said alarm in response to a predetermined liquid level externally of said pump, said pump including an electric motor, a motor power cord attached to said pump and having a power plug remote from said pump, an alarm enclosure in which said alarm is mounted, said power plug being attached to said alarm enclosure, a flexible corrugated tube enclosing said motor power cord, said corrugated tube having alternating circumferential grooves and ridges along the length thereof, said enclosure having front and rear parts with a tube opening therebetween through which said tube extends into said enclosure, and opposed ribs on said front and rear enclosure parts received in at last one of said tube circumferential grooves to prevent relative longitudinal movement between said corrugated tube and said enclosure.

23. The pump of claim 22 including a power cord strain relief on said front enclosure part in aligned spaced relationship with said opposed ribs.

24. The pump of claim 22 including a battery compartment in said enclosure, a battery connector in said battery compartment, said battery connector having battery wires connected with said alarm, and alarm wires extending through said corrugated tube between said alarm switch and said alarm.

25. The pump of claim 22 including a rigid sleeve received within said tube in alignment with said opposed ribs on said enclosure.

26. An electric sump pump having a liquid level sensing alarm switch mounted thereon, an alarm remote from said pump and said alarm switch, said alarm being electrically connected with said alarm switch, said alarm switch being operable to activate said alarm in response to a predetermined liquid level externally of said pump, said pump including a pump housing having a top end, a power cord opening in said top end, a switch support secured to said top end and projecting outwardly therefrom, said alarm switch being attached to said switch support, said switch support having a support sleeve extending upwardly therefrom in alignment with said power cord opening, said support sleeve having longitudinally-spaced circumferential external ribs thereon, a flexible corrugated tube having alternating circumferential external and internal grooves and ridges along the length thereof, said corrugated tube having a tube end portion received over said support sleeve with said external ribs on said support sleeve received in said tube internal grooves, a cover member positioned over said support, said cover member having cooperating opposed parts with a cover opening therebetween receiving said tube end portion, and said cover opening having longitudinally-spaced inwardly extending circumferential ribs received in said tube external grooves.

27. The pump of claim 26 wherein said tube end portion is trapped in uncompressed relationship between said support sleeve and said cover opening so that said tube end portion is rotatable relative to said support sleeve and said cover but is not movable longitudinally relative to said support tube and said cover.

28. An electric sump pump having a liquid level sensing alarm switch mounted thereon, an alarm remote from said pump and said alarm switch, said alarm being electrically connected with said alarm switch, said alarm switch being operable to activate said alarm in response to a predetermined liquid level externally of said pump, an alarm enclosure in which said alarm is mounted, a battery in said enclosure to operate said alarm, and an alarm and battery testing button on said enclosure.

29. The pump of claim 28 wherein said alarm includes both audible and visual alarms mounted on said enclosure.

30. An electric sump pump having a housing, a liquid level sensing alarm switch assembly fixedly mounted on said housing against movement relative thereto, said alarm switch assembly including an alarm switch, an alarm remote from said pump and said alarm switch assembly, said alarm being electrically connected with said alarm switch, said alarm switch being operable to activate said alarm in response to a predetermined liquid level externally of said pump, a switch support secured to said housing and extending outwardly therefrom, and said switch assembly being mounted on said switch support externally of said housing.

31. The pump of claim 30 wherein said switch assembly extends downwardly from said switch support.

32. The pump of claim 30 wherein said housing has a top end and said switch support is secured to said housing top end, said switch support having a cantilevered portion extending outwardly from said housing top end, and said alarm switch assembly being mounted on said cantilevered portion in depending relationship thereto.

33. The pump of claim 32 wherein said cantilevered portion has an opening therein, said alarm switch assembly having an end portion received in said opening and being secured to said cantilevered portion.

34. The pump of claim 33 wherein said end portion of said alarm switch assembly is threaded and is secured to said cantilevered portion by a threaded fastener.

35. An electric sump pump having a housing, a liquid level sensing alarm switch assembly fixedly mounted on said housing against movement relative thereto, said alarm switch assembly including an alarm switch, an alarm remote from said pump and said alarm switch assembly, said alarm being electrically connected with said alarm switch, said alarm switch being operable to activate said alarm in response to a predetermined liquid level externally of said pump, a power cord having one end connected with said pump and an opposite end attached to a power plug remote from said pump, a common enclosure for said plug and alarm, said alarm being enclosed within said enclosure and said plug being at least partly enclosed within said enclosure, whereby insertion of said plug into a socket locates said alarm and enclosure in a remote position from said pump.

* * * * *